US012760448B2

(12) United States Patent
Cascio et al.

(10) Patent No.: US 12,760,448 B2
(45) Date of Patent: *Oct. 13, 2026

(54) SYSTEMS AND METHODS FOR PRODUCING A BUNDLE OF FILAMENTS AND/OR A YARN

(71) Applicant: Aladdin Manufacturing Corporation, Calhoun, GA (US)

(72) Inventors: Anthony Cascio, Calhoun, GA (US); James Mason, Summerville, GA (US); Daniel Amos, Dalton, GA (US); Lucinda Jones, Calhoun, GA (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 52 days.

This patent is subject to a terminal disclaimer.

(21) Appl. No.: 18/785,493

(22) Filed: Jul. 26, 2024

(65) Prior Publication Data

US 2024/0384445 A1 Nov. 21, 2024

Related U.S. Application Data

(63) Continuation of application No. 17/349,699, filed on Jun. 16, 2021, now Pat. No. 12,071,713.

(Continued)

(51) Int. Cl.

| | |
|---|---|
| ***D02G 3/34*** | (2006.01) |
| ***D02G 3/24*** | (2006.01) |
| ***D02J 1/12*** | (2006.01) |

(52) U.S. Cl.

CPC ..... *D02G 3/346* (2013.01); *D02G 3/24* (2013.01); *D02J 1/12* (2013.01)

(58) Field of Classification Search

None

See application file for complete search history.

(56) References Cited

U.S. PATENT DOCUMENTS

| | | | |
|---|---|---|---|
| 3,593,513 | A | 7/1971 | Reese |
| 3,930,782 | A | 1/1976 | Bigland |

(Continued)

FOREIGN PATENT DOCUMENTS

| | | |
|---|---|---|
| CA | 2256050 | 6/1999 |
| CN | 102959145 A | 3/2013 |

(Continued)

OTHER PUBLICATIONS

Terry, 'BCF—Bulk Continuous Filament Carpet Fiber', Feb. 5, 2018 (Feb. 5, 2018) [retrieved from the Internet on Aug. 20, 2021 (Aug. 20, 2021) at <https://www.baneclene.com/professionals//Content.aspx?xps=NTY1>].

(Continued)

*Primary Examiner* — Emmanuel S Luk

(74) *Attorney, Agent, or Firm* — Meunier Carlin & Curfman LLC

(57) ABSTRACT

Systems for producing M bundles of filaments, wherein M≥1, include N extruders, M spin stations, and a processor, wherein N>1. Each extruder includes a thermoplastic polymer having a color, hue, and/or dyability characteristic, which are different from each other. Each spin station produces N bundles of filaments that form a yarn. Each spin station comprises N spinnerets through which filaments are spun from molten polymers streams received by the respective spin station and N spin pumps upstream of the N spinnerets for the respective spin station. Each spin pump is paired with one of the N extruders. The processor is in electrical communication with the N*M spin pumps and is configured to adjust the volumetric flow rate of the polymers pumped from each spin pump to achieve a ratio of the polymers to be included in the yarn from each spin station.

20 Claims, 4 Drawing Sheets

Related U.S. Application Data

(60) Provisional application No. 63/039,630, filed on Jun. 16, 2020, provisional application No. 63/039,626, filed on Jun. 16, 2020.

(56) References Cited

U.S. PATENT DOCUMENTS

| | | | |
|---|---|---|---|
| 4,025,595 | A | 5/1977 | Mirhej |
| 4,112,561 | A | 9/1978 | Norris et al. |
| 4,216,735 | A | 8/1980 | McDaniel |
| 4,708,619 | A | 11/1987 | Balk |
| 4,789,507 | A | 12/1988 | Wesley et al. |
| 5,131,918 | A | 7/1992 | Kelley |
| 5,160,347 | A | 11/1992 | Kay et al. |
| 5,234,650 | A | 8/1993 | Hagen et al. |
| 5,362,563 | A | 11/1994 | Lin |
| 5,549,957 | A | 8/1996 | Negola et al. |
| 5,834,089 | A | 11/1998 | Jones et al. |
| 5,902,531 | A | 5/1999 | Berger et al. |
| 5,958,548 | A | 9/1999 | Negola et al. |
| 5,996,328 | A | 12/1999 | King et al. |
| 6,076,345 | A | 6/2000 | Weiss et al. |
| 6,085,395 | A | 7/2000 | Weiss |
| 6,113,825 | A | 9/2000 | Chuah |
| 6,119,320 | A | 9/2000 | Weiss |
| 6,120,715 | A | 9/2000 | Weigend |
| 6,257,512 | B1 | 7/2001 | Schoeck et al. |
| 6,383,432 | B1 | 5/2002 | Nakajima et al. |
| 6,406,650 | B1 | 6/2002 | Gross et al. |
| 6,900,547 | B2 | 5/2005 | Polk et al. |
| 7,086,130 | B2 | 8/2006 | Jahns et al. |
| 7,651,540 | B2 | 1/2010 | Rao |
| 7,845,923 | B2 | 12/2010 | Lennemann et al. |
| 8,182,550 | B1 | 5/2012 | Hayes |
| 8,597,553 | B1 | 12/2013 | Clark |
| 9,550,338 | B2 | 1/2017 | Clark |
| 2002/0073684 | A1 | 6/2002 | Simmen |
| 2003/0042651 | A1 | 3/2003 | Najour et al. |
| 2005/0008855 | A1 | 1/2005 | Figuly et al. |
| 2005/0048253 | A1 | 3/2005 | Nord et al. |
| 2005/0048281 | A1 | 3/2005 | Royer et al. |
| 2005/0106391 | A1 | 5/2005 | Lawrence et al. |
| 2006/0049542 | A1 | 3/2006 | Chu et al. |
| 2006/0144033 | A1 | 7/2006 | Lee |
| 2009/0208695 | A1 | 8/2009 | Funatsu et al. |
| 2010/0256319 | A1 | 10/2010 | Pereira De Lacerda et al. |
| 2010/0297442 | A1 | 11/2010 | Kalies et al. |
| 2012/0034838 | A1 | 2/2012 | Li et al. |
| 2013/0200544 | A1 | 8/2013 | Hahm et al. |
| 2013/0315029 | A1 | 11/2013 | Helbing et al. |
| 2015/0275400 | A1 | 10/2015 | Tung |
| 2018/0363239 | A1 | 12/2018 | Love et al. |
| 2019/0085483 | A1 | 3/2019 | Clark |
| 2019/0105283 | A1 | 4/2019 | Anderson et al. |
| 2019/0315962 | A1 | 10/2019 | Booth et al. |
| 2019/0360129 | A1 | 11/2019 | Nasri et al. |
| 2020/0102698 | A1 | 4/2020 | Lu |
| 2020/0115824 | A1 | 4/2020 | Stündl et al. |
| 2020/0291547 | A1 | 9/2020 | Fischer et al. |
| 2020/0324454 | A1 | 10/2020 | Sauer |
| 2021/0388531 | A1 | 12/2021 | Cascio et al. |

FOREIGN PATENT DOCUMENTS

| | | | |
|---|---|---|---|
| GB | 1275572 | | 5/1972 |
| GB | 1348923 | A | 3/1974 |
| JP | 3088597 | | 9/2000 |
| JP | 2005060850 | | 3/2005 |
| KR | 2017-0089267 | A | 8/2017 |
| WO | 1995014806 | | 6/1995 |
| WO | 2001073189 | | 10/2001 |
| WO | 2007121696 | A1 | 11/2007 |
| WO | 2009037118 | | 3/2009 |
| WO | 2015039971 | | 3/2015 |
| WO | 2020123127 | | 6/2020 |
| WO | 2021257733 | | 12/2021 |
| WO | 2021257739 | | 12/2021 |

OTHER PUBLICATIONS

International Search Report and Written Opinion issued in PCT/US2021/063605, mailed Mar. 8, 2022, 15 pages.

Non-Final Office Action issued in co-pending U.S. Appl. No. 17/349,696, mailed Sep. 7, 2023, 10 pages.

International Search Report and Written Opinion mailed Feb. 7, 2020, in PCT/US19/62873 (11 pages).

Extended European Search Report completed Jul. 15, 2019, in related European application EP 19152387.7 (7 pages).

International Search Report and Written Opinion issued in PCT/US2022/026128, mailed Jul. 29, 2022, 8 pages.

Non-Final Office Action issued in U.S. Appl. No. 17/349,731, mailed Apr. 3, 2024.

International Search Report and Written Opinion issued in PCT/US2021/037684, dated Nov. 1, 2021.

International Search Report and Written Opinion issued in PCT/US2021/037673, dated Nov. 9, 2021.

International Search Report and Written Opinion issued in PCT/US2021/037687, dated Nov. 1, 2021.

Non-Final Office Action issued in U.S. Appl. No. 17/349,696, mailed Mar. 14, 2024.

Non-Final Office Action issued in U.S. Appl. No. 17/413,356, mailed May 16, 2024.

Non-Final Office Action issued in U.S. Appl. No. 17/349,696, mailed Nov. 8, 2024.

Office Action for U.S. Appl. No. 18/719,779 dated Jun. 9, 2026, 6 pages.

Office Action for U.S. Appl. No. 18/719,783 dated Jun. 16, 2026, 13 pages.

Radial cross section of yarn

Roll of yarn

SYSTEMS AND METHODS FOR PRODUCING A BUNDLE OF FILAMENTS AND/OR A YARN

CROSS REFERENCE TO RELATED APPLICATIONS

This application is a continuation of U.S. application Ser. No. 17/349,699, filed Jun. 16, 2021, which claims the benefit of U.S. Provisional Patent Application No. 63/039,630, filed Jun. 16, 2020, and U.S. Provisional Patent Application No. 63/039,626, filed Jun. 16, 2020.

BACKGROUND

Melt spun filaments, such as melt spun filaments of PET are known in the art. Some types of polymers, hence filaments, strands or bundles, are difficult to dye, or to provide with a color varying along the length of the filament, bundle or strand.

It is known to change the color of filaments in a bundle by changing the dye sourcing. However, this process is time consuming and can be wasteful. In addition, it is also known in US Published Patent Application No. 2010/0297442 to vary the output of spin pumps when spinning a plurality of filament bundles that each have a different color to provide a color variation along the length of a composite thread made with the plurality of filament bundles.

However, a need in the art exists for systems and methods for improving the color variation of a bundle of filaments and/or a yarn.

BRIEF SUMMARY

Various implementations include systems and methods of providing multifilament bundles of melt spun polymer filaments that provide a color variation along the length of the filament, bundle, or strand.

According to a first aspect, a system for producing a bundle of filaments comprises N extruders, wherein N is an integer greater than 1, M spin stations, wherein M is an integer of 1 or more, and a processor. Each extruder comprises a thermoplastic polymer having a color, hue, and/or dyability characteristic. The colors, hues, and/or dyability characteristics of the thermoplastic polymers in the N extruders are different from each other. M spin stations are for receiving molten polymer streams from the N extruders. Each spin station spins N bundles of filaments that are combined into a yarn. Each spin station comprises N spinnerets through which a plurality of melt-spun filaments are spun from each of the N molten polymer streams received by the spin station and N spin pumps upstream of the N spinnerets. Each spin pump is in fluid communication and is paired with one of the N extruders. The processor is in electrical communication with the N*M spin pumps. The processor is configured to execute computer readable instructions that cause the processor to adjust a volumetric flow rate of the thermoplastic polymers pumped by each spin pump in each spin station to achieve a ratio of the thermoplastic polymers to be included in the yarn that comprises the N bundles of filaments spun from the respective spin station. The volumetric flow rates extruded by each of the spin pumps in a respective one of the M spin stations is greater than zero and is variable such that flow of the polymer streams through the spinnerets of the respective spin station is continuous and supports continuous filament formation and wherein the volumetric flow rate of at least one pump in each spin station is variable by more than ±40% of a baseline volumetric flow rate, wherein the baseline volumetric flow rate is equal to a total volumetric flow rate through the spin station divided by N.

In some implementations, the instructions further cause the processor to determine the volumetric flow rate of each thermoplastic polymer to be pumped by each spin pump and generate the instructions to the spin pumps based on the volumetric flow rate determinations.

In some implementations, the instructions also cause the processor to adjust the timing of the volumetric flow rate changes and hence adjust the corresponding denier and/or color changes in the yarn. The instructions cause the processor to adjust the speeds and volumetric flow rates of some or all of the spin pumps for an amount of time based on a desired color variation in the yarn.

In some implementations, the instructions cause the processor 110 to randomize the amount of time that the speeds and volumetric flow rates through some or all of the spin pumps are varied.

In some implementations, M is greater than 1 and the system comprises at least a first spin station and a second spin station, wherein the ratio is a first ratio for the first spin station and a second ratio for the second spin station, and wherein a sum of the volumetric flow rates extruded from each extruder by the spin pumps paired with the respective extruder varies 0 to ±5%. In some implementations, the first ratio and the second ratio are different.

In some implementations, an average denier of each yarn varies by ±5% or less along a length of each yarn.

In some implementations, the yarn from each M spin station has a color, hue, and/or dyability characteristic that is a mixture of the color, hue, and/or dyability characteristic of the thermoplastic polymers being extruded from the N extruders.

In some implementations, M is two or more, and the ratios to be included in each of the M yarns are different.

In some implementations, the system further comprises at least one drawing device to elongate said N bundles of spun filaments; an initial tacking device upstream to or integrated within the at least one drawing device to tack at least one of said N bundles of spun filaments prior to or during the elongation of the N bundles of spun filaments; at least one texturizer to texturize said N bundles of elongated spun filaments; and a final tacking device to tack said N bundles of texturized spun filaments to provide a BCF yarn.

In some implementations, the at least one texturizer comprises at least a first texturizer and a second texturizer, and at least one of said N bundles of spun filaments is texturized individually from the other N bundles of spun filaments through the first texturizer.

In some implementations, the at least one texturizer comprises N texturizers, and each of said N bundles of spun filaments are texturized individually from each other through respective N texturizers.

In some implementations, the system further comprises an intermediate tacking device and a mixing cam disposed between the at least one texturizer and the final tacking device, the intermediate tacking device for tacking at least one of said N bundles of texturized spun filaments and the mixing cam for positioning tacked and texturized bundles relative one to the other before reaching the final tacking device.

In some implementations, the system further comprises at least one drawing device to elongate said N bundles of spun filaments; at least a first texturizer and a second texturizer, wherein at least one of said N bundles of elongated spun filaments is texturized individually through the first texturizer separately from the other said N bundles of elongated spun filaments; and a final tacking device to tack said N bundles of texturized spun filaments to provide a BCF yarn.

In some implementations, the system further comprises an intermediate tacking device disposed between the at least one texturizer and the final tacking device, the intermediate tacking device for tacking at least one of said N bundles of texturized spun filaments.

In some implementations, the system further comprises a mixing cam disposed between the at least one texturizer and the final tacking device, the mixing cam for positioning tacked and texturized bundles relative to one to the other before reaching the final tacking device.

In some implementations, the system further comprises at least one drawing device to elongate said N bundles of spun filaments; at least one texturizer to texturize said N bundles of elongated spun filaments; a second tacking device disposed between the texturizers and the final tacking device, the second tacking device for tacking at least one of said N bundles of texturized spun filaments; and a final tacking device to tack said N bundles of texturized spun filaments to provide a BCF yarn.

In some implementations, the system further comprises a mixing cam disposed between the texturizers and the final tacking device, the mixing cam for positioning tacked and texturized bundles relative to one to the other before reaching the final tacking device.

In some implementations, a plurality of bundles of filaments are produced using the system according to the first aspect.

In some implementations, a yarn includes the bundles of filaments produced using the system of the first aspect.

And, in some implementations, the yarn is a bulked continuous filament (BCF) yarn.

According to a second aspect, a method to produce at least one bundle of filaments comprises (1) providing N streams of molten thermoplastic polymer, wherein N is an integer greater than 1, and each stream has a different color, hue, and/or dyability characteristic; (2) providing M spin stations, wherein M is an integer of 1 or more, each spin station having N plates for receiving the N streams of thermoplastic polymer, N spinnerets, and N spin pumps, each spin pump pumping one of the N streams of thermoplastic polymer to one of the N plates, and each of the N plates being in fluid communication with one of the N spinnerets, the N spin pumps being disposed upstream of N plates and N spinnerets; and (3) adjusting a volumetric flow rate of each thermoplastic polymer stream pumped to the respective spinneret of the spin station to achieve a ratio of the thermoplastic polymer streams to be included in a yarn, the yarn comprising bundles of filaments spun from the spinnerets of each spin station, wherein the volumetric flow rate extruded by each spin pump in a respective one of the M spin stations is greater than zero and is variable such that the flow of the polymer streams through the spinnerets of the respective spin station is continuous and supports continuous filament formation and wherein the volumetric flow rate of at least one pump in each spin station is variable by more than ±40% of a baseline volumetric flow rate, wherein the baseline volumetric flow rate is equal to a total volumetric flow rate through the spin station divided by N.

In some implementations, M is greater than one, and the M spin stations comprise a first spin station and a second spin station, and the ratio is a first ratio for the first spin station and a second ratio for the second spin station, and a sum of the volumetric flow rates extruded from each extruder by the spin pumps paired with the respective extruder varies 0 to ±5%.

In some implementations, the first ratio and the second ratio are different.

In some implementations, a plurality of bundles of filaments are produced according to the method of the second aspect. In some implementation, a yarn comprises the bundles of filaments produced using the method according to the second aspect. In some implementations, the yarn is a bulked continuous filament (BCF) yarn.

According to a third aspect, a yarn comprises a plurality of bundles of filaments, wherein at least two of the bundles of filaments have different colors, hues, and/or dyability characteristics, and a sum of areas of radial cross-sections of filaments in each respective bundle of filaments varies along a length of the respective bundle of filaments. In other words the denier per filament of filaments in one or more bundles of filaments is varied along their length. An increase of the denier per filament in a certain bundle leads to the properties, such as color, hue, and/or dyability, of these filaments to become more prevalent within the yarn. By varying the denier in two or more bundles of differently colored filaments, an effect may be obtained which is interpreted by the human eye as a mixed color. For example, when a bundle of yellow filaments and a bundle of cyan filaments are present in the yarn, green may be obtained when both bundles have filaments of about equal size. And, as the filament size of the cyan filaments are decreased and the filament size of the yellow filaments are increased, the yarn may turn more and more yellow to the human eye, or more and more cyan when the variation in size is opposite.

In some implementations, a sum of the areas of the radial cross-sections of all filaments in a radial cross-section of the yarn varies by 5% or less along a length of the yarn.

In some implementations, for filaments in the same bundle of filaments, the variation in the area of the radial cross-section along the length of each filament occurs at a common radial cross-section of the respective bundle of filaments, the common radial cross-section of the respective bundle of filaments lying within a plane that perpendicularly intersects a central axis of the respective bundle of filaments. Put differently, the variation of the denier per filament is preferably substantially synchronized in a bundle.

In some implementations, within a plane that perpendicularly intersects a central axis of the yarn, the sum of the areas of radial cross-sections of the filaments in one respective bundle of filaments is different than the sum of areas of radial cross-sections of the filaments in at least one other bundle of filaments. The yarn of the third aspect may be obtained in various manners, including using a system of the first aspect and/or using the method of the second aspect, and/or their respective preferred implementations. Preferably a bundle of filaments in the yarn of the third aspect is obtained from the respective spinnerets mentioned in the first and/or second aspect. The yarn of the third aspect may further show preferred characteristics equal or similar to yarns obtained with the first and/or second aspect, without necessarily having been obtained in that manner.

In some implementations, the filaments have a multi-lobal cross section. For example, some implementations have a three-lobal (or tri-lobal) cross-section. The multi-lobal cross-section is advantageous, since the filaments with larger cross-section tend to hide the filaments with smaller cross-section more effectively, such that a broader range of variation in properties, such as color, hue and dyability, can be obtained when varying the size of the filaments in the respective bundles.

In some implementations, the filaments of one or more bundles comprised in the yarn are colored, preferably with a dye extending through the full mass of the filament.

In a fourth aspect, a carpet, rug, or carpet tile (collectively referred to herein as "carpet") is provided comprising pile made with the yarn of the third aspect and/or obtained using the methods and/or systems of any of the first or second aspects.

BRIEF DESCRIPTION OF THE DRAWINGS

Example features and implementations are disclosed in the accompanying drawings. However, the present disclosure is not limited to the precise arrangements shown, and the drawings are not necessarily drawn to scale.

DETAILED DESCRIPTION

Figure 1:
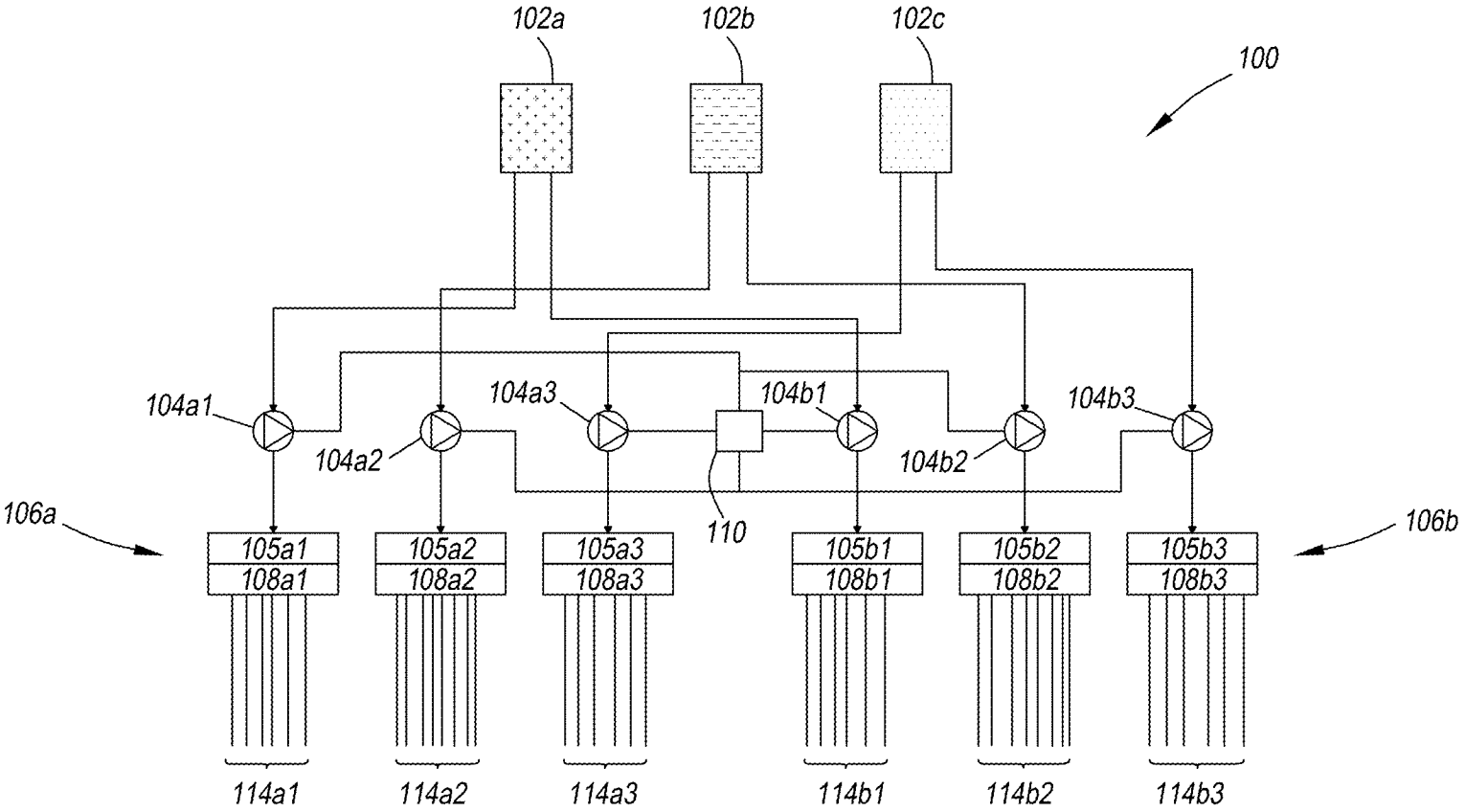
FIG. 1 illustrates a schematic diagram of a system according to one implementation.
Figure 2:
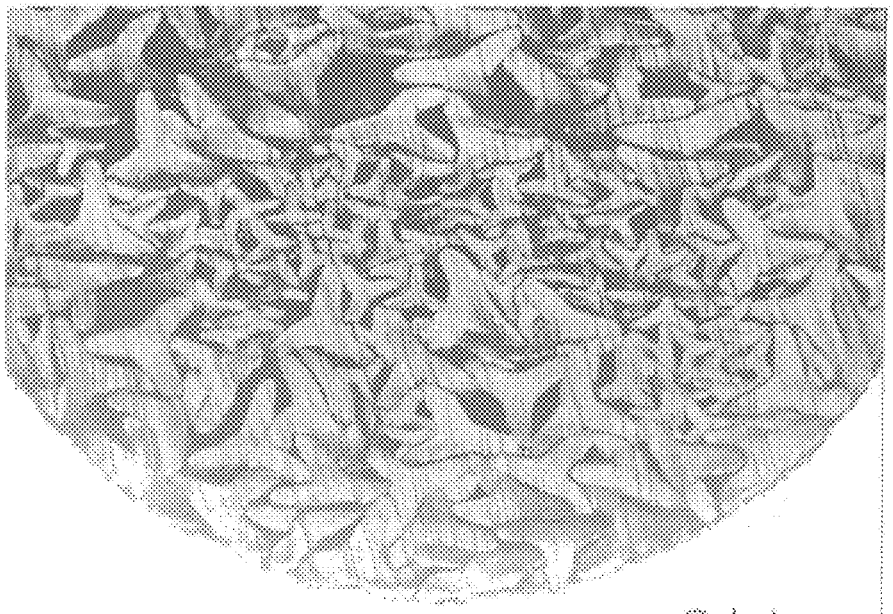
FIG. 2 illustrates a roll of yarn made using the system of FIG. 1 and a radial cross-section of the yarn, according to one embodiment.
Figure 2:
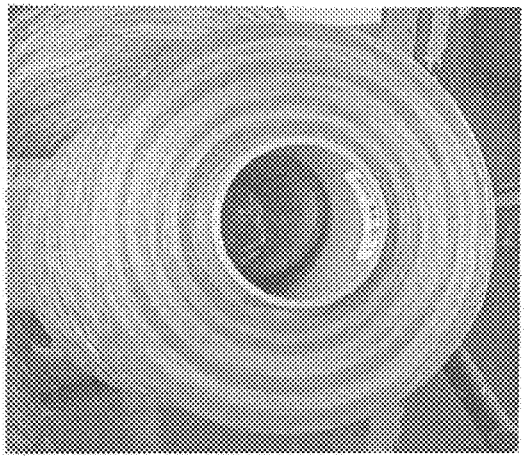

Various implementations include systems and methods for producing bundles of filaments, yarn(s) made therefrom, and carpet(s) made from the yarn. The system allows for the color effect of or mix of colors within a yarn to be changed by altering the volumetric flow rate of spin pumps that are in fluid communication and paired with a plurality of extruders that each include a thermoplastic polymer having a different color, hue, and/or dyability characteristic than the other extruders.

According to a first aspect, a system for producing a bundle of filaments, the system comprises N extruders, wherein N is an integer greater than 1, M spin stations, wherein M is an integer of 1 or more, and a processor. Each extruder comprises a thermoplastic polymer having a color, hue, and/or dyability characteristic. The colors, hues, and/or dyability characteristics of the thermoplastic polymers in the N extruders are different from each other. M spin stations are for receiving molten polymer streams from the N extruders. Each spin station spins N bundles of filaments that are combined into a yarn. Each spin station comprises N spinnerets through which a plurality of melt-spun filaments are spun from each of the N molten polymer streams received by the spin station and N spin pumps upstream of the N spinnerets. Each spin pump is in fluid communication and is paired with one of the N extruders. The processor is in electrical communication with the N*M spin pumps. The processor is configured to execute computer readable instructions that cause the processor to adjust a volumetric flow rate of the thermoplastic polymers pumped by each spin pump in each spin station to achieve a ratio of the thermoplastic polymers to be included in the yarn that comprises the N bundles of filaments spun from the respective spin station. The volumetric flow rates extruded by each of the spin pumps in a respective one of the M spin stations is greater than zero and is variable such that flow of the polymer streams through the spinnerets of the respective spin station is continuous and supports continuous filament formation and is variable by more than ±40% of a baseline volumetric flow rate, wherein the baseline volumetric flow rate is equal to a total volumetric flow rate through the spin station divided by N.

According to a second aspect, a method to produce at least one bundle of filaments comprises (1) providing N streams of molten thermoplastic polymer, wherein N is an integer greater than 1, and each stream has a different color, hue, and/or dyability characteristic; (2) providing M spin stations, wherein M is an integer of 1 or more, each spin station having N plates for receiving the N streams of thermoplastic polymer, N spinnerets, and N spin pumps, each spin pump pumping one of the N streams of thermoplastic polymer to one of the N plates, and each of the N plates being in fluid communication with one of the N spinnerets, the N spin pumps being disposed upstream of N plates and N spinnerets; and (3) adjusting a volumetric flow rate of each thermoplastic polymer stream pumped to the respective spinneret of the spin station to achieve a ratio of the thermoplastic polymer streams to be included in a yarn, the yarn comprising bundles of filaments spun from the spinnerets of each spin station, wherein the volumetric flow rate extruded by each spin pump in a respective one of the M spin stations is greater than zero and is variable such that the flow of the polymer streams through the spinnerets of the respective spin station is continuous and supports continuous filament formation and wherein the volumetric flow rate of at least one pump in each spin station is variable by more than ±40% of a baseline volumetric flow rate, wherein the baseline volumetric flow rate is equal to a total volumetric flow rate through the spin station divided by N.

According to a third aspect, a yarn comprises a plurality of bundles of filaments, wherein at least two of the bundles of filaments have different colors, hues, and/or dyability characteristics, and a sum of areas of radial cross-sections of filaments in each respective bundle of filaments varies along a length of the respective bundle of filaments.

In a fourth aspect, a carpet, rug, or carpet tile (collectively referred to herein as "carpet") is provided comprising pile made with the yarn of the third aspect and/or obtained using the methods and/or systems of any of the first or second aspects.

For example, FIG. 1 illustrates a schematic diagram of a system according to one implementation. The system 100 includes a first extruder 102*a*, a second extruder 102*b*, a third extruder 102*c*, a first spin station 106*a*, and a second spin station 106*b*. Each spin station 106*a*, 106*b* includes three spinneret 108*a*1, 108*a*2, 108*a*3, 108*b*1, 108*b*2, 108*b*3, a first spin pump 104*a*1, 104*b*1, a second spin pump 104*a*2, 104*b*2, a third spin pump 104*a*3, 104*b*3, and manifold plates 105*a*1, 105*a*2, 105*a*3, 105*b*1, 105*b*2, 105*b*3 through which molten thermoplastic polymer streams flow from the pumps 104*a*1, 104*a*2, 104*a*3, 104*b*1, 104*b*2, 104*b*3 to the spinnerets 108*a*1, 108*a*2, 108*a*3, 108*b*1, 108*b*2, 108*b*3. The system 100 also includes a processor 110 in electrical communication with the spin pumps 104*a*1, 104*a*2, 104*a*3, 104*b*1, 104*b*2, 104*b*3. The first spin pumps 104*a*1, 104*b*1 are in fluid communication and are paired with the first extruder 102*a*, the second spin pumps 104*a*2, 104*b*2 are in fluid communication and are paired with the second extruder 102*b*, and the third spin pumps 104*a*3, 104*b*3 are in fluid communication and are paired with the third extruder 102*c*.

Each extruder 102*a*, 102*b*, 102*c* includes a thermoplastic polymer having a color, hue, and/or dyability characteristic. The colors, hues, and/or dyability characteristics in each extruder 102*a*, 102*b*, 102*c* are different from each other. Spin pumps 104*a*1, 104*a*2, 104*a*3, 104*b*1, 104*b*2, 104*b*3 pump the molten thermoplastic polymer through the plates 105*a*1, 105*a*2, 105*a*3, 105*b*1, 105*b*2, 105*b*3, which feeds the molten polymer through the spinnerets 108*a*1, 108*a*2, 108*a*3, 108*b*1, 108*b*2, 108*b*3.

Bundles of filaments 114*a*1, 114*a*2, 114*a*3, are spun through spinnerets 108*a*1, 108*a*2, 108*a*3 spin, respectively, of the first spin station 106*a*, and these bundles 114*a*1, 114*a*2, 114*a*3 are eventually processed into a first yarn. And, bundles of filaments 114*b*1, 114*b*2, 114*b*3 are spun through spinnerets 108*b*1, 108*b*2, 108*b*3, respectively, of the second spin station 106*b*, and these bundles 114*b*1, 114*b*2, 114*b*3 are eventually processed into a second yarn.

Examples of thermoplastic polymers that may be used for the filaments named in any of the first through fourth aspects include polyamides, polyesters, and polyolefins. For example, the polymer may be aromatic or aliphatic polyamide, such as PA6, PA66, PA6T, PA10, PA12, PA56, PA610, PA612, PA510. The polyamide can be a polyamide blend (copolymer) or homopolymer or partially recycled or fully based upon recycled polyamide.

In other implementations of any of the first through fourth aspects, the polymer may be polyester, such as polyethylene terephthalate (PET), polybutyl terephthalate (PBT), or polytrimethylene terephthalate (PTT). The PET can be virgin PET or partially or fully based upon recycled PET, such as the PET described in U.S. Pat. No. 8,597,553.

In yet other implementations of any of the first through fourth aspects, the polymer may be a polyolefin, such as polyethylene (PE) or polypropylene (PP). In certain implementations, the polymer is PET, PTT, PP, PA6, PA66 or PES.

In some implementations of any of the first through fourth aspects, the bundles are made from the same polymer. However, in other implementations, bundles may be made from different polymers.

According to some implementations, the polymer of the filaments may be solution dyed polymer. In some implementations, the solution dyed polymer filaments are space dyed after processing (also referred to as "over dying"). And, in other implementations, the filaments are not solution dyed and are space dyed or dyed regularly after processing. A solution dyed polymer has coloring agent added prior to filament formation out of the spinneret. A space dyed polymer has a coloring agent that is added to the filament after formation out of the spinneret. Dyability characteristic refers to a filament's affinity to absorb a dye under the same processing conditions. For example, non-solution-dyed filaments may appear white after spinning due to the lack of presence of dye molecules, pigments, or other molecules that would provide a different color than the material substrate. When subjected to a dyeing process, for example PET using disperse dyes, a molten stream formed with a deep dye PET would have a darker color saturation than a molten stream produced with a traditional PET.

By increasing the denier per filament of filaments in one or more bundles of filaments of the yarn, the color from that group of filaments is visibly more prevalent in the yarn. If other process controls are the same, increasing the speed of the spin pump increases the volumetric flow rate of the molten thermoplastic polymer through the spinneret in fluid communication with the spin pump, and an increased volumetric flow rate through the spinneret increases the average denier per filament of the filaments spun through the spinneret. Conversely, decreasing the speed of the spin pump decreases the volumetric flow rate of the molten thermoplastic polymer through the spinneret in fluid communication with the spin pump, and a decreased volumetric flow rate through the spinneret reduces the average denier per filament of the filaments spun through the spinneret. Thus, the average denier per filament of the filaments in each filament bundle can be increased or decreased by changing the speed (and thus the volumetric flow rates) of the respective pump(s) in communication with the spinnerets through which the filaments in each bundle are spun. Increasing and decreasing the speed of at least one or more pumps can also be varied according to a certain frequency and amplitude, in some implementations, creating portions of a length of the bundle that have a higher DPF than other portions of the length.

The processor 110 is configured to execute computer readable instructions that cause the processor 110 to adjust the volumetric flow rate of the molten thermoplastic polymer pumped by each spin pump 104*a*1, 104*a*2, 104*a*3, 104*b*1, 104*b*2, 104*b*3 to achieve a ratio of the thermoplastic polymers to be included in the first yarn and the second yarn produced by spin stations 106*a*, 106*b*, respectively. Adjusting the volumetric flow rate of the thermoplastic polymer displaced by each of the extruders 102*a*, 102*b*, 102*c* by each spin pump 104*a*1, 104*a*2, 104*a*3, 104*b*1, 104*b*2, 104*b*3 adjusts the ratio of the thermoplastic polymers in each yarn, which changes the overall color, hue, and/or dyability characteristic of the yarn. The ratio of the thermoplastic polymers to be included in each yarn refers to the ratio of colors, hues, and/or dyability characteristics from each extruder 102*a*, 102*b*, 102*c* that are included in each yarn. A first ratio of the thermoplastic polymers to be included in the first yarn may or may not be different from a second ratio of the thermoplastic polymers to be included in the second yarn. Each yarn includes a first bundle of filaments 114*a*1, 114*b*1 having the color, hue, and/or dyability characteristic of the polymer in the first extruder 102*a*, a second bundle of filaments 114*a*2, 114*b*2 having the color, hue, and/or dyability characteristic of the polymer in the second extruder 102*b*, and a third bundle of filaments 114*a*3, 114*b*3 having the color, hue, and/or dyability characteristic of the polymer in the third extruder 102*c*. When the bundles of filaments 114*a*1, 114*a*2, 114*a*3 from the first spin station 106*a* are brought together into the first yarn and the bundles of filaments 114*b*1, 114*b*2, 114*b*3 from the second spin station 106*b* are brought together into the second yarn, the bundles of filaments 114*a*1, 114*a*2, 114*a*3, 114*b*1, 114*b*2, 104*b*3 in each yarn provide a color and/or hue appearance that depends on the relative linear densities, or titer (e.g., also referred to as "denier per filament", "denier per fiber" or "DPF")) per filament, of each filament in each bundle 114*a*1, 114*a*2, 114*a*3, 114*b*1, 114*b*2, 114*b*3.

Thus, the overall color, hue, and/or dyability characteristic of each yarn can be altered by altering the relative denier per filament of the filaments from each extruder 102*a*, 102*b*, 102*c* along the length of the filaments. The desired denier per filament of the filaments in each filament bundle 114*a*1, 114*a*2, 114*a*3, 114*b*1, 114*b*2, 114*b*3 depends on the volumetric flow rate through each pump 104*a*1, 104*a*2, 104*a*3, 104*b*1, 104*b*2, 104*b*3. For example, if the desired overall color for the first yarn is the color of the polymer in extruder 102*a*, then the processor 110 adjusts the volumetric flow rate of the pumps 104*a*1, 104*a*2, 104*a*3 such that the denier per filament of the filaments in bundle 114*a*1 is larger than the denier per filament of the filaments in bundles 114*a*2 and 114*a*3. This combination results in the appearance that the first yarn has the color of the polymer in extruder 102*a* because the filaments with the smaller denier are not as prominent. For example, if the total volumetric flow rate is 360 $cm^3$/minute for one of the spin stations and there are three spin pumps for each spin station, then a baseline volumetric flow rate for each pump in that spin station is 120 $cm^3$/minute. If the desired overall color for the yarn from that spin station is the color of the polymer in extruder 102*a*, then the volumetric flow rate of the pump in fluid communication with extruder 102*a* is increased by more than 40% of the baseline volumetric flow rate (e.g., increase from 120 $cm^3$/minute to greater than 168 $cm^3$/minute), and the volumetric flow rates of the other pumps are decreased. For example, if the total volumetric flow rate through the spin station is to remain constant and the volumetric flow rate of the pump in fluid communication with extruder 102*a* is increased to 220 $cm^3$/minute, then the volumetric flow rates of the other pumps may be decreased to 70 $cm^3$/minute each.

As another example, if the desired overall color for the first yarn is a mixture of the colors of the polymers in extruders 102*a* and 102*b*, then the processor 110 adjusts the volumetric flow rate of the pumps 104*a*1, 104*a*2, 104*a*3 such that the denier per filament of the filaments in bundles 114*a*1 and 114*a*2 are larger than the denier per filament of the filaments in bundle 114*a*3. This combination results in the appearance that the first yarn has a color that is a mixture of the colors of the polymers in extruder 102*a* and 102*b* because the filaments with the smaller denier are not as prominent. For example, if the total volumetric flow rate is 360 $cm^3$/minute for one of the spin stations and there are three spin pumps for each spin station, then a baseline volumetric flow rate for each pump in that spin station is 120 $cm^3$/minute. If the desired overall color for the yarn from that spin station is achieved by using an equal mixture of the colors of the polymers in extruders 102*a* and 102*b*, then the volumetric flow rates of the pumps in fluid communication with the extruders 102*a* and 102*b* are increased by more than 40% of the baseline volumetric flow rate (e.g., increase from 120 $cm^3$/minute to greater than 168 $cm^3$/minute), and the volumetric flow rate of the other pump is decreased. For example, if the total volumetric flow rate through the spin station is to remain constant and the volumetric flow rates of the pumps in fluid communication with extruders 102*a* and 102*b* are increased to 170 $cm^3$/minute, then the volumetric flow rate of the other pump is decreased to 20 $cm^3$/minute.

As a third example, if the desired overall color of the first yarn is an even mixture of the colors from all three extruders 102*a*, 102*b*, 102*c*, then the processor 110 adjusts the volumetric flow rate of the pumps 104*a*1, 104*a*2, 104*a*3 to the baseline volumetric flow rate such that the denier per filament of the filaments in bundles 114*a*1, 114*a*2, and 114*a*3 are the substantially same.

This system 100 allows for yarns to be made having more colors and/or hues than the number of extruders providing each color or hue. For example, if the extruders 102*a*-102*c* each have thermoplastic polymers solution dyed red, blue, and yellow, various ratios of these thermoplastic polymers yield yarns having these colors and combinations thereof, such as purple, orange, and green.

For example, in some implementations, the speed of each spin pump 104*a*1, 104*a*2, 104*a*3, 104*b*1, 104*b*2, 104*b*3 is at least 2 RPM. And, in certain implementations, a maximum speed of each spin pump 104*a*1, 104*a*2, 104*a*3, 104*b*1, 104*b*2, 104*b*3 is 30 RPM. However, in other implementations, the maximum speed of each spin pump may be higher.

In addition, a sum of the volumetric flow rates extruded from each extruder by the spin pumps paired with the respective extruder varies 0 to ±5%. For example, the total volumetric flow rate being extruded from extruder 102*a* is the sum of the volumetric flow rate being extruded by pump 104*a*1 and the volumetric flow rate being extruded by pump 104*b*1. Similarly, the total volumetric flow rate being extruded from extruder 102*b* is the sum of the volumetric flow rate being extruded by pump 104*a*2 and the volumetric flow rate being extruded by pump 104*b*2. And, the total volumetric flow rate being extruded from extruder 102*c* is the sum of the volumetric flow rate being extruded by pump 104*a*3 and the volumetric flow rate being extruded by pump 104*b*3. These total volumetric flow rates are constant or do not vary more than ±5%, according to some implementations. Accordingly, in some implementations, the sum of the areas of radial cross-sections of all filaments in a radial cross-section of the yarn varies by ±5% or less. However, the average denier of the yarn from the first spin station 106*a* may be different from the average denier of the yarn from the second spin stations 106*b*.

In other implementations, the volumetric flow rate displaced by each pump that is paired with a particular extruder is not limited relative to the volumetric flow rate displaced by the other pumps unless there is a desire to maintain a constant throughput of the extruder with which the pumps are paired.

In some implementations, the instructions also cause the processor 110 to determine the volumetric flow rate of each thermoplastic polymer to be pumped by each spin pump 104*a*1, 104*a*2, 104*a*3, 104*b*1, 104*b*2, 104*b*3 to achieve the desired ratio and generate the instructions to the spin pumps 104*a*1, 104*a*2, 104*a*3, 104*b*1, 104*b*2, 104*b*3 based on the volumetric flow rate determinations. However, in other implementations, the volumetric flow rate for each spin pump 104*a*1, 104*a*2, 104*a*3, 104*b*1, 104*b*2, 104*b*3 may be determined by another processor or otherwise input into the system 100. In addition, in other implementations, the instructions to the spin pumps 104*a*1, 104*a*2, 104*a*3, 104*b*1, 104*b*2, 104*b*3 may be generated by another processor or otherwise input into the system 100.

In various embodiments, the volumetric flow rate extruded by each of the spin pumps of a respective spin station is greater than zero, and the volumetric flow rate of at least one pump in each spin station is variable by more than ±40% of a baseline volumetric flow rate, wherein the baseline volumetric flow rate is equal to a total volumetric flow rate through the spin station divided by N. The volumetric flow rate can be varied such that the flow of the polymer streams through the spinnerets of the respective spin station are continuous and support continuous filament formation. The variation in the volumetric flow rate of the thermoplastic polymer may be based on, but is not limited to, the type of polymer, a size and/or shape of the capillaries of the spinneret, the temperature of the polymer, and the denier per filament of the filaments spun from that spinneret.

Figure 4:
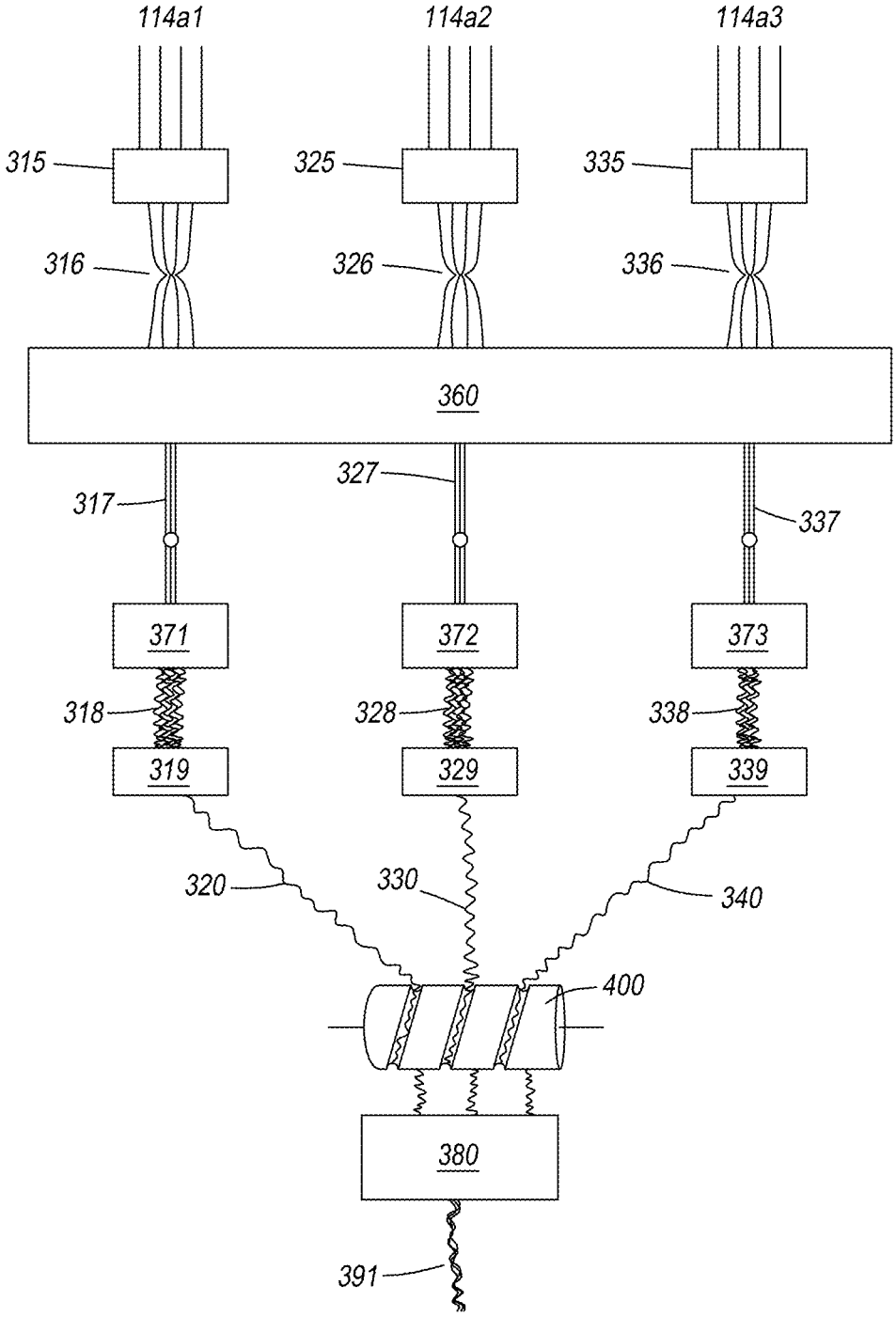
FIG. 4 illustrates a schematic diagram of optional post-spinning processes for the system shown in FIG. 1.

In some implementations, the computer readable instructions are stored on a computer memory that is in electrical communication with the processor 110 and disposed near the processor (e.g., on the same circuit board and/or in the same housing). And, in other implementations, the computer readable instructions are stored on a computer memory that is in electrical communication with the processor but is remotely located from the processor. FIG. 4, which is described below, illustrates an example computing system that includes a processor 1021, which can include processor 110. The system in FIG. 4 may be used by system 100, for example.

The radial cross-sectional shape of each filament in any of the first through fourth aspects may be the same as the other filaments or different, e.g. depending on the shapes of the openings defined by the spinneret through which each filament is spun. For example, the filaments may have radial cross sections that are circular, trilobal, fox, or other suitable shape. In addition, the filaments may be solid or define at least one hollow void. Similarly, the size of the spinneret openings may be the same or different, depending on the desired denier per filament for each filament.

In addition, in some implementations, a speed at which the system 100 is run (e.g., velocity at which yarn produced by the system 100 can be made) may be adjusted based on the variation of the DPF of the filaments in each filament bundle 114*a*1, 114*a*2, 114*a*3, 114*b*1, 114*b*2, 114*b*3 to prevent the filaments with a lower DPF from breaking. Examples of other factors that may be considered in selecting the system speed include, but are not limited to, polymer temperature, polymer type, capillary size and shape of the spinnerets, volumetric flow rates, and/or quenchability.

The speed at which the system 100 is run also may be increased or decreased based on the desired appearance. And depending on the operating parameters of the system, a change in speed may not affect the appearance of the yarn.

In some implementations, the instructions also cause the processor 110 to adjust the timing of the volumetric flow rate changes and hence adjust the corresponding denier and/or color changes in the yarn. For example, the following description is for a sequence of steps performed by the processor 110. At step 1, the instructions cause the spin pump 104*a*1 to be at a higher speed (for example, 50% of maximum speed) and the spin pump 104*a*2 and 104*a*3 to be at a lower speed (for example, each at 25% of maximum speed) for an initial x1 seconds (for example, x1 is 1 sec, 2 secs, 3 secs, 4, secs, 5 secs, 6 secs, 7 secs, 8 secs, and so on). The amount of time that a specific combination of spin pump speeds is held determines the length of the particular color pattern produced by the combination of the spin pump speeds in the yarn. After the initial x1 seconds, at step 2, the instructions cause the processor 110 to change the speeds of the pumps such that the spin pumps 104*a*1 and 104*a*2 are at a lower speed (for example 25% of maximum speed) and the spin pump 104*a*3 is at a higher speed (for example 50% of maximum speed) for x2 seconds. In some embodiments, x1=x2, and in other embodiments, x1 is different from x2. At step 3, after the x2 seconds elapses, the instructions cause the processor 110 to change the speeds of the pumps such that the spin pumps 104*a*1 and 104*a*3 are at a lower speed (for example at 25% of maximum speed) and spin pump 104*a*2 is at a higher speed (for example at 50% of maximum speed) for x3 seconds. Again, x3 can be equal to x1 and/or x2. In other embodiments, x3 can be different from x1 and/or x2. After x3 seconds, at step 4, the instructions cause the processor 110 to change the speeds of the pumps such that the spin pumps 104*a*1, 104*a*2, 104*a*3 are at the same speed (for example, each at 33.33% of the maximum speed). The above sequence or a variation thereof is repeated to produce the desired color variation in the yarn.

In another example implementation, the instructions cause the processor 110 to randomize the above steps to produce random color variation in the yarn. For example, an internal clock associated with the processor 110 selects an overall timer with a first random number greater than 0 and to and including y secs (for example, y can be 5 secs, 6 secs, 7 secs, 7.5 secs, 8 secs, 9 secs, 10 secs, and so on). Then the instructions cause the processor 110 to select a second set of random numbers for each of x1, x2, x3, and x4 in step 1-4 above (for example, x1=2 secs, x2=3 secs, x3=1 sec, x4=2 sec). As the instructions cause the processor to execute steps 1-4, the overall timer based on the first random number (for example, y=7.5 secs) decides when the process is reset. In the above example, when the time associated with the overall timer elapses, the instructions cause the processor 110 to terminate step 4 at x4=1.5 secs and restart the process steps from step 1 to step 4. In other embodiments, the steps 1-4 described above can be executed by the processor 110 in any order. The processor can also randomize the sequence of steps 1-4. In other embodiments, the speed of the pumps 104*a*1, 104*a*2, 104*a*3 for each of the above steps is randomized. For example, at step 1, the instructions cause the processor 110 to change the speed of the pumps such that pumps 104*a*1 and 104*a*2 are at a random lower speed (for example, at 20% of maximum speed and 28% maximum speed respectively) and spin pump 104*c* is at a higher speed (for example, at 52% of maximum speed).

Filaments produced using the system 100 have better wear properties because the color and/or dye extends through the full mass of the filament. Having the dye extend through the entire filament also improves the appearance of cut pile in carpets. In addition, the system 100 is faster and less expensive than prior art systems because the average denier of the yarn can be kept substantially constant and the pumps 104*a*1, 104*a*2, 104*a*3, 104*b*1, 104*b*2, 104*b*3 do not have to stop to allow for changes in the color of the yarn produced. This system 100 also produces less waste by avoiding the need to stop and start at each color change.

For solution dyed filaments, each filament in the yarn has a color and/or hue from an external surface to a center thereof, and for at least a subset of the plurality of filaments, the denier per filament of each filament within the subset varies along a length of the filament.

In some implementations, the yarn is bulked continuous filament (BCF) yarn. The yarn is made according to any of the processes described above and/or by any of the systems described above. In addition, some implementations include a carpet that includes pile made with this yarn.

The yarn may be a bulked continuous filament (BCF) yarn that may be (1) extruded and drawn in a continuous operation, (2) extruded, drawn, and textured in a continuous operation, (3) extruded and taken up in one step and is then later unwound, drawn, and textured in another step, or (4) extruded, drawn, and textured in one or more operations.

Furthermore, in some implementations, the BCF yarn could be used as yarn in carpet or in apparel, for example.

In addition, in some implementations, carpet having changing colors, such as the carpet described above, can be made from one continuous BCF yarn, instead of having to stop the process to switch out yarn having a different color.

The bundles 114*a*1, 114*a*2, 114*a*3, 114*b*1, 114*b*2, 114*b*3 produced by system 100 in FIG. 1 can be drawn separately by drawing device (not shown in FIG. 1), which is one or more godets, after the spinning process to their final denier per filament, assuming that the filaments in the bundles 114*a*1, 114*a*2, 114*a*3, 114*b*1, 114*b*2, 114*b*3 are not subject to breakage due to their denier per filament, radial cross-sectional shape, or otherwise. In other implementations, the drawing device can also include a draw point localizer.

In some embodiments of any of the first through fourth aspects, the DPF of the filaments in each of the bundles are equal. However, in other embodiments, at least some of the filaments in one bundle may have a different DPF than the other filaments in the bundle. Or, in some embodiments, the filaments in one bundle may have the same DPF as other filaments in the bundle but the DPF of those filaments may be different from the DPF of the filaments in another bundle. And, in some embodiments, the number of filaments in the bundles are equal. And, in other embodiments, the number of filaments in each bundle may differ.

It is remarked that where notice is made of different or varying colors or hue, at least a color or hue difference as expressed with a Delta E value of 1.0 is preferred. Even better the difference or variation at least encompasses a color or hue difference as expressed by Delta E of at least 5.0 or at least 10.0. Delta E is a measure of change in visual perception of two given colors.

Figure 3:
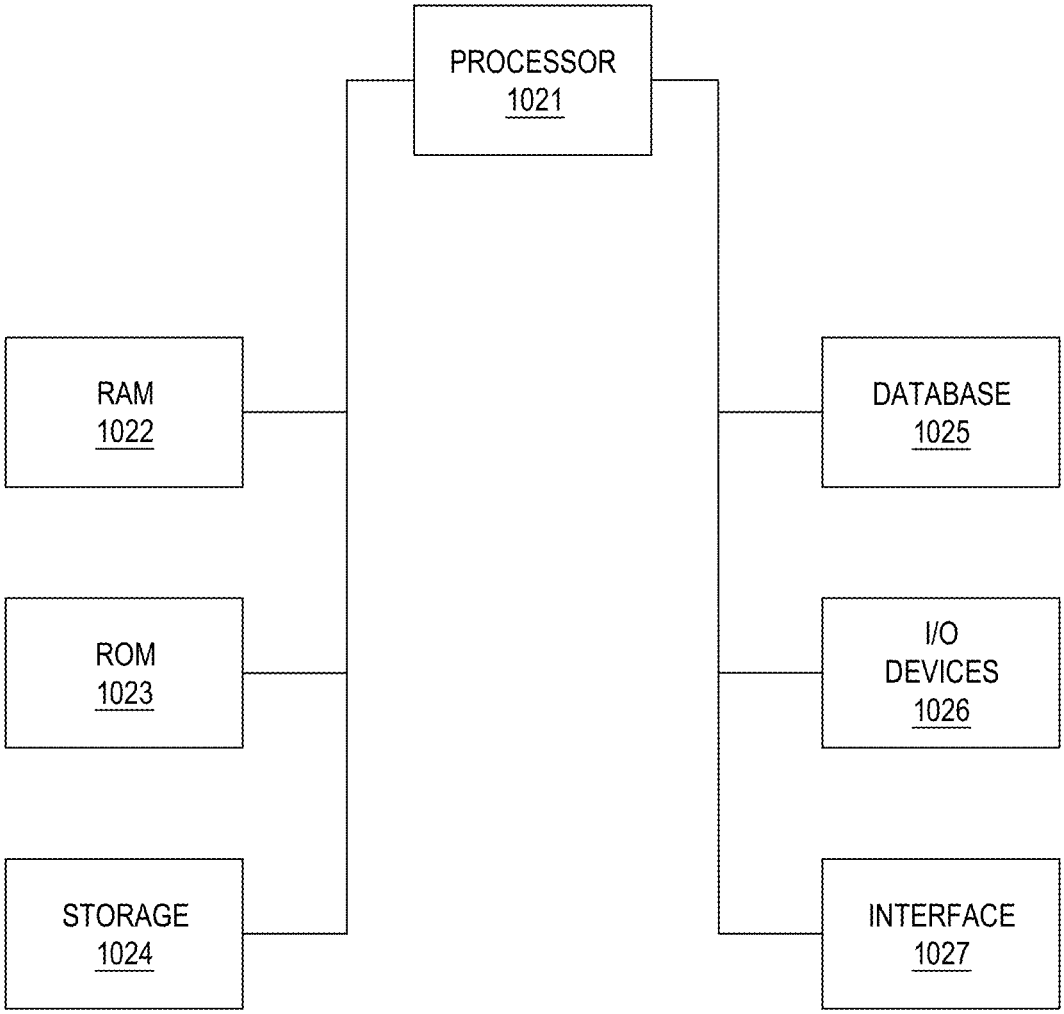
FIG. 3 illustrates an example computing device that can be used according to embodiments described herein.

FIG. 3 illustrates an example computing device that can be used for controlling the pumps of the system 100. As used herein, "computing device" or "computer" may include a plurality of computers. The computers may include one or more hardware components such as, for example, a processor 1021, a random access memory (RAM) module 1022, a read-only memory (ROM) module 1023, a storage 1024, a database 1025, one or more input/output (I/O) devices 1026, and an interface 1027. All of the hardware components listed above may not be necessary to practice the methods described herein. Alternatively and/or additionally, the computer may include one or more software components such as, for example, a computer-readable medium including computer executable instructions for performing a method associated with the example embodiments. It is contemplated that one or more of the hardware components listed above may be implemented using software. For example, storage 1024 may include a software partition associated with one or more other hardware components. It is understood that the components listed above are examples only and not intended to be limiting.

Processor 1021 may include one or more processors, each configured to execute instructions and process data to perform one or more functions associated with a computer for producing at least one bundle of filaments and/or at least one yarn. Processor 1021 may be communicatively coupled to RAM 1022, ROM 1023, storage 1024, database 1025, I/O devices 1026, and interface 1027. Processor 1021 may be configured to execute sequences of computer program instructions to perform various processes. The computer program instructions may be loaded into RAM 1022 for execution by processor 1021.

RAM 1022 and ROM 1023 may each include one or more devices for storing information associated with operation of processor 1021. For example, ROM 1023 may include a memory device configured to access and store information associated with the computer, including information for identifying, initializing, and monitoring the operation of one or more components and subsystems. RAM 1022 may include a memory device for storing data associated with one or more operations of processor 1021. For example, ROM 1023 may load instructions into RAM 1022 for execution by processor 1021.

Storage 1024 may include any type of mass storage device configured to store information that processor 1021 may need to perform processes consistent with the disclosed embodiments. For example, storage 1024 may include one or more magnetic and/or optical disk devices, such as hard drives, CD-ROMs, DVD-ROMs, or any other type of mass media device.

Database 1025 may include one or more software and/or hardware components that cooperate to store, organize, sort, filter, and/or arrange data used by the computer and/or processor 1021. For example, database 1025 may store computer readable instructions that cause the processor 1021 to adjust the volumetric flow rate of the thermoplastic polymers pumped by each spin pump to achieve a ratio of the thermoplastic polymers to be included in a yarn that includes the bundles of filaments spun from the spin station. It is contemplated that database 1025 may store additional and/or different information than that listed above.

I/O devices 1026 may include one or more components configured to communicate information with a user associated with computer. For example, I/O devices may include a console with an integrated keyboard and mouse to allow a user to maintain a database of digital images, results of the analysis of the digital images, metrics, and the like. I/O devices 1026 may also include a display including a graphical user interface (GUI) for outputting information on a monitor. I/O devices 1026 may also include peripheral devices such as, for example, a printer for printing information associated with the computer, a user-accessible disk drive (e.g., a USB port, a floppy, CD-ROM, or DVD-ROM drive, etc.) to allow a user to input data stored on a portable media device, a microphone, a speaker system, or any other suitable type of interface device.

Interface 1027 may include one or more components configured to transmit and receive data via a communication network, such as the Internet, a local area network, a workstation peer-to-peer network, a direct link network, a wireless network, or any other suitable communication platform. For example, interface 1027 may include one or more modulators, demodulators, multiplexers, demultiplexers, network communication devices, wireless devices, antennas, modems, and any other type of device configured to enable data communication via a communication network.

FIG. 4 illustrates a schematic diagram of optional post-spinning processes for a portion of the bundle of filaments 114*a*1, 114*a*2, 114*a*3 from the spinning system in FIG. 1. These optional post-spinning processes enhance the color contributed to the yarn by each bundle of filaments 114*a*1, 114*a*2, 114*a*3. FIG. 4 illustrates these processes with respect to the bundles of filaments 114*a*1, 114*a*2, 114*a*3, but these processes may be used with other groups of bundles of filaments, such as 114*b*1, 114*b*2, and 114*b*3. Each process can be used when there are two or more spun filament bundles that have different colors and/or hues. The processes include (1) tacking spun filaments in at least one bundle separately from the other bundles after spinning and prior to or during the drawing process, (2) texturing tacked spun filaments in at least one bundle separately from the other bundles after the drawing process, and (3) tacking textured and tacked spun filaments in at least one bundle separately from the other bundles and feeding the bundles to a mixing cam that feeds the bundles to a final tacking device for tacking together the bundles into a yarn.

As shown in FIG. 4, each bundle of spun filaments 114*a*1, 114*a*2, 114*a*3 are tacked individually by a tacking device 315, 325, 335 respectively. In other words, each bundle 114*a*1, 114*a*2, 114*a*3 is physically separated from the other bundle and only filaments belonging to the respective bundle are tacked together. The tacking devices 315, 325, 335 are air entanglers. The tacking is done with air entangling every 6 to 155 mm (e.g., 20 to 50 mm). In addition, the tacking devices 315, 325, 335 may use 2 to 6 bar pressure, but the pressure may increase with an increased number of filaments, increased denier per filament, and/or increased speed of filament production.

The tacking devices 315, 325, 335 are air entanglers that use room temperature air for entangling the filaments. In other embodiments, the tacking devices include heated air entanglers (e.g., air temperature is higher than room temperature) or steam entanglers, for example.

The bundles of tacked filaments 316, 326, 336 are drawn to the final titer by drawing device 360, which is a plurality of godets. The godets are each turned at a different speed, according to some embodiments. The draw ratio is typically 1.5 to 4.5. Each filament is drawn to a titer of 2 to 40 titer (or DPF). Three bundles of elongated spun filaments 317, 327, 337 are provided after drawing.

When looking along the axial length of the yarn 391, the position of the filaments originating from bundles 114*a*1, 114*a*2, 114*a*3 are more pronounced in the yarn 391 than if the bundles of filaments 114*a*1, 114*a*2, 114*a*3 had not been individually tacked with tacking devices 315, 325, 335.

In alternative embodiments (not shown in FIG. 4), air entanglement can be applied to one or more of the bundles by turning off or on air to 315, 325, 326. In addition, in other embodiments, air can be applied constantly or in an on/off sequence to get the desired end effect.

And, in yet another embodiment (not shown in FIG. 4), the bundles of spun filaments are first elongated partially before being tacked individually. After the tacking step, the spun, tacked bundles are further elongated to the final denier.

Next, to further enhance the color of each bundle within the yarn, each bundle of tacked and drawn filaments 317, 327, 337 are texturized separately through texturizers 371, 372, 373, respectively. Following this step, bundles 318, 328, 329 of texturized filaments are provided.

The texturizers 371, 372, 373 may apply air, steam, heat, mechanical force, or a combination of one of more of the above to the filaments to cause the filaments to bulk (or crimp/shrink). The bundles 317, 327, 337 are texturized to have a bulk (or crimp or shrinkage) of 5-20%. Texturizing individual bundles of filaments separately, when using bundles with different colors and/or hues, provides a more pronounced color and/or hue along the axial length of the BCF yarn. The filaments that are texturized separately tend to stay more grouped together during the rest of the production steps to make the BCF yarn, which results in the color and/or hue of this bundle of spun filaments being more pronounced along the length of the BCF yarn.

Next, the texturized filaments 318, 328, 338 are provided to an individual color entanglement process prior to the final tacking at tacking device 380. In this individual color entanglement process, the bundles 318, 328, 338 of texturized filaments are fed into separate tacking devices 319, 329, 339 to tack individually each bundle of texturized spun filaments. Tacking devices 319, 329, 339 are air entanglers that use room temperature air applied at 2 bar to 6 bar pressure, for example, for entangling the filaments every 15 to 155 mm. But the pressure may increase with an increased number of filaments, increased denier per filament, and/or increased speed of filament production. And, in other embodiments, the tacking devices 319, 329, 339 include heated air entanglers (e.g., air temperature is higher than room temperature) or steam entanglers, for example. The tacking may be done more frequently for a specific look desired. For example, with more frequent tacking, the yarn looks less bulky and the color separation is reduced, which results in a more blended look for the colors.

After being individually tacked with tacking devices 319, 329, 339, the bundles 320, 330, 340 are guided to a mixing cam 400. The mixing cam 400 positions bundles tacked by tacking devices 319, 329, 339 relative to each other prior to being tacked together in final tacking device 380. The mixing cam 400 is cylindrical and has an external surface defining a plurality of grooves for receiving and guiding the texturized and tacked bundles.

The mixing cam 400 is rotatable about its central axis or can be held stationary. If rotated, the mixing cam 400 varies which side of the bundles are presented to the tacking jet in the tacking device 380, which affects how the bundles (and filaments therein) are layered relative to each other. In some embodiments, the positions are randomly varied. The speed of rotation can be changed to provide a different appearance in the yarn 391. For example, one or more of the bundles 320, 330, 340 may have a first color on one side of the bundle 320, 330, 340 and a second color on another side of the bundle 320, 330, 340, wherein the sides of the bundle are circumferentially spaced apart but intersected by the same radial plane. It may be desired to have the first color on an exterior facing surface of an arc in a carpet loop in one area of the carpet and the second color on an exterior facing surface of an arc in a carpet loop in another area of the carpet. Rotating the cam 400 may "flip" one or more of the bundles 320, 330, 340 about its axis such that the desired color is oriented on a portion of the outer surface of the yarn 391 such that the desired color is on the exterior facing surface of the arc in the carpet loop. The undesired color for that portion of the carpet is hidden on the inside facing surface of the loop. Rotation of the cam 400 ensures that the filaments that run on the outside of the loop are changing due to a specific mechanical means and not necessarily natural occurrences in downstream processes.

When stationary, the positions of the bundles 320, 330, 340 are directed by the mixing cam 400 to the final tacking device 380 but their relative positions are not varied. In alternative embodiments, the bundles 320, 330, 340 are fed to the tacking device 380 directly or they are fed via a stationary guide disposed between the intermediate tacking devices 319, 329, 339 and the tacking device 380.

The tacked texturized bundles 320, 330, 340 positioned by mixing cam 400 are thereafter tacked together by tacking device 380 into a BCF yarn 391. This tacking is done with air entangling every 12 to 80 mm.

Tacking device 380 is an air entangler that uses room temperature air applied at 2 bar to 6 bar pressure, for example, for entangling the filaments. But the pressure may increase with an increased number of filaments, increased denier per filament, and/or increased speed of filament production. And, in other embodiments, the tacking device 380 includes heated air entanglers (e.g., air temperature is higher than room temperature) or steam entanglers, for example. The bundles 320, 330, 340 are tacked and as such provide a BCF yarn 391 comprising an average of 24-360 filaments of 2 to 40 DPF each. The tacking may be done more frequently for a specific look desired. For example, with more frequent tacking, the yarn looks less bulky and the color separation is reduced, which results in a more blended look for the colors.

The effect of this individual tacking and guidance via a mixing cam cause the colors and/or hues in the yarn to be more structured and positioned. When such yarn is used as for example, a tufting yarn in a tufted carpet, the positioning of the colored bundles in the yarn cause bundles to be more pronounced in the final carpet surface. The positioning of the color and/or hue in the BCF yarn has as effect that this color and/or hue can be locally more present on the top side of the tuft oriented upwards, away from the backing of the carpet, or hidden at the low side of the tuft oriented towards the backing of the carpet. The effect is the provision of very vivid and pronounced color zones on the carpet.

Various implementations have been described. Nevertheless, it will be understood that various modifications may be made without departing from the spirit and scope of the description. Accordingly, other implementations are within the scope of the following claims.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

The terminology used herein is for the purpose of describing particular implementations only and is not intended to be limiting of the disclosure. As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The invention claimed is:

1. A system for producing a yarn, comprising:

N extruders, wherein:

N is an integer greater than 1, each extruder is configured to extrude an individual extruder volume of extruded molten thermoplastic over a time period;

M spin stations, wherein:

each spin station is configured to receive a portion of the individual extruder volume from each of the N extruders during the time period and to extrude one bundle of filaments for each of the N extruders, such that a sum of the portions of the individual extruder volumes received by all of the M spin stations during the time period is a sum of the individual extruder volumes extruded by the N extruders during the time period;

N spin pumps within each spin station, wherein:

each spin pump is in fluid communication with only one extruder, each spin pump is configured to pump the portion of the received individual extruder volume within the time period at a baseline volumetric flow rate, such that a sum of the portions of the individual extruder volumes received by that spin station divided by N is the baseline volumetric flow rate for that spin station;

a processor configured to monitor the time and to control each of the N spin pumps within each spin station such that each spin pump may be controlled to vary a pump rate by up to ±40% of the baseline volumetric flow rate;

wherein the processor is configured to control at least one spin pump within at least one spin station to vary the pump rate at least once within the time period, and such that for each extruder the individual extruder volume of extruded molten thermoplastic will remain constant or vary by less than ±5% during the time period.

2. The system for producing a yarn of claim 1, wherein each of the M spin stations comprises drawing equipment to gather the bundles of filaments into one yarn for each spin station such that M yarns are produced.

3. The system for producing a yarn of claim 2, wherein the processor is configured to separate the time period into a plurality of time intervals, wherein during each time interval the processor is configured to control the at least one spin pump within the at least one spin station to vary its pump rate at least once within each time interval.

4. The system for producing a yarn of claim 3, wherein the at least one spin pump within the at least one spin station is controlled by the processor to vary its pump rate at least once within each time interval, and such that an average denier of the yarn produced from that spin station will vary by less than ±5% during the time period.

5. The system for producing a yarn of claim 2, wherein the plurality of drawing devices are configured to elongate a first bundle of filaments.

6. The system for producing a yarn of claim 5, wherein:

a first drawing device of the plurality of drawing devices comprises a first tacking device configured to tack the first bundle of filaments prior to or during the elongation of the first bundle of filaments.

7. The system for producing a yarn of claim 6, wherein the first drawing device comprises at least one texturizer to texturize the first bundle of filaments.

8. The system for producing a yarn of claim 7, wherein the time intervals are instructions configured within the processor.

9. The system for producing a yarn of claim 8, wherein the processor is configured to randomize the time intervals.

10. The system for producing a yarn of claim 1, wherein the at least one spin pump within the at least one spin station is configured to vary its pump rate by more than ±40% of the baseline volumetric flow rate.

11. The system for producing a yarn of claim 10, wherein each of the M spin stations comprises drawing equipment to gather the bundles of filaments into one yarn for each spin station such that M yarns are produced.

12. The system for producing a yarn of claim 11, wherein the processor is configured to separate the time period into a plurality of time intervals, wherein during each time interval the processor is configured to control the at least one spin pump within the at least one spin station to vary its pump rate at least once within each time interval.

13. The system for producing a yarn of claim 12, wherein the at least one spin pump within the at least one spin station controlled by the processor to vary its pump rate at least once within each time interval, and such that an average denier of the yarn produced from that spin station will vary by less than ±5% during the time period.

14. The system for producing a yarn of claim 13, further comprising:

at least one drawing device to elongate said N bundles of spun filaments;

at least one texturizer to texturize said N bundles of elongated spun filaments;

a second tacking device disposed between the texturizers and the final tacking device, the second tacking device for tacking at least one of said N bundles of texturized spun filaments; and a final tacking device to tack said N bundles of texturized spun filaments to provide a BCF yarn.

15. The system of claim 14, further comprising a mixing cam disposed between the texturizers and the final tacking device, the mixing cam for positioning tacked and texturized bundles relative to one to the other before reaching the final tacking device.

16. A system for producing a yarn, comprising:

a plurality of extruders comprising a first extruder and a second extruder, wherein each extruder is configured to extrude a total volumetric flow rate of molten thermoplastic;

a plurality of spin stations comprising a first spin station and a second spin station, wherein:

each spin station is configured to receive at least a portion of the molten thermoplastic from each extruder of the plurality of extruders and to extrude a plurality of filaments, such that a sum of the portions of the molten thermoplastic received by each spin station is the total volumetric flow rate of that spin station, the plurality of filaments extruded from the first spin station has at least a different color, hue, or dyability characteristic than a plurality of filaments extruded from the second spin station;

a plurality of spin pumps within each spin station, wherein:

a number of spin pumps within each spin station is the same as a number of extruders;

each spin pump within each spin station is in fluid communication with only one extruder, each spin pump within each spin station is configured to pump the received molten thermoplastic at a rate that is more than ±40% of a baseline volumetric flow rate for that spin station, such that the baseline volumetric flow rate for that spin station is the total volumetric flow rate of that spin station divided by the number of spin pumps within that spin station;

a processor configured to monitor the time and to control each spin pump such that the rate of pumping the molten thermoplastic may be changed;

wherein the processor is configured to control a first spin pump in the first spin station to increase or decrease its rate of pumping during a time period; and wherein the total volumetric flow rate of the second spin station remains constant or varies by less than 5% during the time period.

17. The system for producing a yarn according to claim 16, wherein the first spin pump is configured to increase or decrease the volumetric flow rate by an amount of greater than 40% over the baseline volumetric flow rate.

18. The system for producing a yarn according to claim 16, wherein the plurality of filaments extruded from the second spin station has an average denier, such that the average denier will vary by 5% or less during the time period.

19. The system for producing a yarn according to claim 18, wherein the controller controls all other spin pumps within the first spin station such that the total volumetric flow rate within the first spin station changes 5% or less during the time period.

20. The system for producing a yarn according to claim 19, wherein the controller controls all spin pumps within the second spin station such that the total volumetric flow rate within the second spin station changes 5% or less during the time period.

* * * * *